US005462220A

United States Patent [19]

Bacchetti et al.

[11] Patent Number: 5,462,220

[45] Date of Patent: Oct. 31, 1995

[54] SHIPPING AND DISPLAY BOX

[75] Inventors: Mark R. Bacchetti; Ronald E. Heiskell, both of Tracy; Ezra E. Theys, San Mateo, all of Calif.

[73] Assignee: Advanced Container Corporation, Tracy, Calif.

[21] Appl. No.: 395,648

[22] Filed: Feb. 28, 1995

Related U.S. Application Data

[63] Continuation of Ser. No. 191,172, Feb. 3, 1994, abandoned.

[51] Int. Cl.[6] ..... B65D 21/032

[52] U.S. Cl. ..... 229/112; 229/119; 229/120; 229/122; 229/162; 229/916

[58] Field of Search ..... 229/40, 112, 113, 229/119, 120, 122, 915, 916, 939, 162

[56] References Cited

U.S. PATENT DOCUMENTS

| | | | |
|---|---|---|---|
| 2,843,307 | 7/1958 | Goltz | 229/915 |
| 2,955,733 | 10/1960 | Wilson | 229/113 |
| 3,356,283 | 12/1967 | Champlin | 229/40 |
| 3,863,829 | 2/1975 | Merrill | 229/112 |
| 3,881,648 | 5/1975 | Hall | 229/112 |
| 4,245,771 | 1/1981 | Christian | 229/112 |
| 4,353,495 | 10/1982 | Jes | 229/119 |
| 4,529,117 | 7/1985 | Brundage | 229/113 |
| 5,163,069 | 11/1992 | Muise, Jr. | 229/113 |
| 5,181,651 | 1/1993 | Oppenheim | 229/120 |
| 5,263,612 | 11/1993 | Nederveld | 229/113 |

FOREIGN PATENT DOCUMENTS

| | | | |
|---|---|---|---|
| 2240156 | 3/1975 | France | 229/120 |
| 2319610 | 11/1974 | Germany | 229/915 |

OTHER PUBLICATIONS

Eight photographs of "Grandmom's Box" manufactured by Surpack S. A. of Peru.

*Primary Examiner*—Gary E. Elkins

*Attorney, Agent, or Firm*—Burns, Doane, Swecker & Mathis

[57] ABSTRACT

A shipping and display box is provided that has stacking holes in a bottom wall and stacking tabs protruding above a top wall for being received in stacking holes of a second shipping and display box stacked on top of the shipping and display box to prevent relative movement of the stacked boxes and to align the stacked boxes and facilitate drainage of water from the second shipping and display box into lower shipping and display boxes. Drain holes are formed proximate edges of the bottom wall of the shipping and display box, and diverter tabs are formed in side walls. The holes formed proximate the edge of the bottom wall facilitate drainage of water from an upper stacked box into holes formed by the diverter tabs in the side walls of lower stacked boxes. The shipping and display boxes are in the form of truncated pyramids to facilitate the cascading of water from upper boxes down through lower stacked boxes and to facilitate air ventilation by forming air passageways when the boxes are tightly stacked on a pallet. The shipping and display box is assembled using integrally formed flaps and slots. A blank for forming the shipping and display box and a method of assembling the blank into the shipping and display box are also described.

17 Claims, 9 Drawing Sheets

SHIPPING AND DISPLAY BOX

This application is a continuation of application Ser. No. 08/191,172, filed Feb. 3, 1994, now abandoned.

BACKGROUND OF THE INVENTION

1. Field of the Invention

The present invention relates to shipping and display boxes and, more particularly, to shipping and display boxes for fresh products such as asparagus.

2. State of the Art

The market for fresh products such as asparagus is widespread, and produce grown in areas such as California finds a market in distant areas such as the Eastern United States as well as in Europe. Produce such as fresh asparagus requires special handling techniques prior to and during shipment to maintain freshness. Typically, fresh asparagus is packed upright, with the bottom ends of the asparagus facing downward and delicate tips facing upward to prevent damage. An absorbent pad is placed in the bottom of a packing container and is soaked with water for keeping the asparagus moist during transport.

Asparagus, will continue to grow in the packing containers unless it is kept below 60 degrees F. Accordingly, it is common to "hydro-cool" asparagus prior to shipping and to refrigerate the asparagus prior to and during shipping to maintain freshness and prevent growth. In hydro-cooling, the asparagus is soaked with cold water, usually between 34 and 40 degrees F., and the packed asparagus is then taken to a cold room, which is approximately 35 degrees F., before it is shipped in a refrigerated truck. The low temperatures prevent growth of the packed asparagus. Further, it is desirable to provide ample ventilation and water drainage of the asparagus in the packing containers to prevent rot and deterioration.

Such treatment of asparagus has required that the asparagus be shipped in packing containers that are waterproof. Because of the need to soak the packing containers with water in the hydro-cooler prior to and sometimes after transportation, prior corrugated packing containers have generally not permitted containers on pallets more than one layer high, in part because water in the hydro-cooler is unable to reach the packing containers at the bottom of the pallet and containers within the center of the pallet stack. Further, even where it is possible to stack packing containers top of one another, the packing containers tend to slide around relative to one another during transportation, usually because of the slick material, such as wax, used to waterproof the material forming the container. The sliding of the packing containers risks damage to the packed products. It is desirable to provide a waterproof packing container for shipping of fresh products that is able to provide for hydro-cooling of multiple stacks of packing containers, that offers sufficient ventilation and water drainage to the packed products to prevent the formation of rot and deterioration, that prevents relative movement of stacked packing containers during transportation, and that is able to withstand the force of multiple packed packing containers stacked on top of each other, and the impact forces due to transportation.

Most known packing containers for shipping fresh produce such as asparagus are formed by using staples and straps to hold the walls together. When the packing container reaches its destination, the merchant must generally destroy the packing container to remove the packed products. Further, the use of staples or straps to assemble the packing container is undesirable, at least because of the cost of fasteners, cost of labor to assemble with fasteners, and the cost to maintain the fastener equipment. Some packing containers, such as the shipping and display container shown in U.S. Pat. No. 3,863,829 to Merrill, offer the advantage of permitting a front and top wall of the packing container to be folded back to permit viewing and removal of the packed products. That packing container, however, relies on staples or other fastening means for assembly. Accordingly, it is desirable to provide a packing container that is adapted both for shipping and display of the packed product, and that does not require fasteners for its assembly.

SUMMARY OF THE INVENTION

The present invention, generally speaking, provides a packing container or box for shipment and display of fresh products. The packing container is adapted to be stacked on top of or below other, like packing containers, that permits hydro-cooling of multiple, stacked packing containers, that minimizes the retention of water within the packing container, that minimizes the relative movement of stacked packing containers during transportation, that maximizes air ventilation within a pallet stack, with minimum dimensions to maximize the number the number of packing containers in transportation vehicles, such as trucks, cargo ships, and airplanes.

In accordance with one aspect of the present invention a stackable box includes a horizontal bottom wall provided with one or more openings, a horizontal top wall, and a front and a rear wall extending between the top wall and the bottom wall. Upwardly extending stacking tabs are provided, at least one stacking tab being disposed at each of a top front and a top rear corner of the box, the stacking tabs being adapted to be received in openings provided in a bottom wall of a second box stacked on top of the box.

In accordance with another aspect of the present invention, a stackable box includes a horizontal bottom wall provided with one or more first holes proximate an edge of the bottom wall, and an upwardly extending wall attached at an edge of the bottom wall so that the upwardly extending wall and the bottom wall form an angle of less than ninety degrees, measured on an inner side of the box. One or more first holes are provided proximate the edge of the bottom wall and second holes, corresponding in number to the first holes, are provided in the upwardly extending wall, the second holes being provided vertically above the first holes. When a second stackable box of the same type as the stackable box is stacked on top of the stackable box, the first holes of the second stackable box are vertically above the second holes so that fluid in the second stackable box is adapted to flow out of the first holes of the second stackable box and into the stackable box through the second holes.

In accordance with another aspect of the present invention a box includes a bottom wall and a rear wall, at least a portion of the rear wall being hingedly attached at a rear edge to the bottom wall. The box further includes a left side wall, at least a portion of the left side wall being hingedly attached to a left edge of the bottom wall, and a right side wall, at least a portion of the right side wall being hingedly attached to a right edge of the bottom wall. The box further includes a top wall, at least a portion of the top wall being hingedly attached to one of the rear wall, the left side wall, and the right side wall. The box further includes a primary front wall, at least a portion of the primary front wall being hingedly attached to a front edge of the bottom wall, and a secondary front wall, at least a portion of the secondary front wall being hingedly attached to a front edge of the top wall. Integral slot and flap means for securing the bottom wall, the rear wall, the left side wall, the right side wall, the top wall, the primary front wall, and the secondary front wall relative to one another are provided.

In accordance with another aspect of the present invention, a blank for forming a box includes a bottom wall portion for forming a bottom wall, and a first portion including a central portion hingedly attached to a rear edge of the bottom wall portion for forming a rear wall, and left and right portions at left and right edges of the central portion. The blank further includes a second portion hingedly attached to a front edge of the bottom wall portion for forming a primary front wall, and a third portion including a primary portion hingedly attached to a left edge of the bottom wall portion and a secondary portion hingedly attached to a front edge of the primary portion. The blank further includes a fourth portion including a primary portion hingedly attached to a right edge of the bottom wall portion and a secondary portion hingedly attached to a front edge of the primary portion, and a top wall portion, the top wall portion being hingedly attached to one of a left edge of the primary portion of the third portion, a right edge of the primary portion of the fourth portion, and a rear edge of the first portion.

BRIEF DESCRIPTION OF THE DRAWINGS

The present invention can be further understood with reference to the following description in conjunction with the appended drawings, wherein like elements are provided with the same reference numerals. In the drawings.

DETAILED DESCRIPTION OF THE PREFERRED EMBODIMENTS

Figure 1:
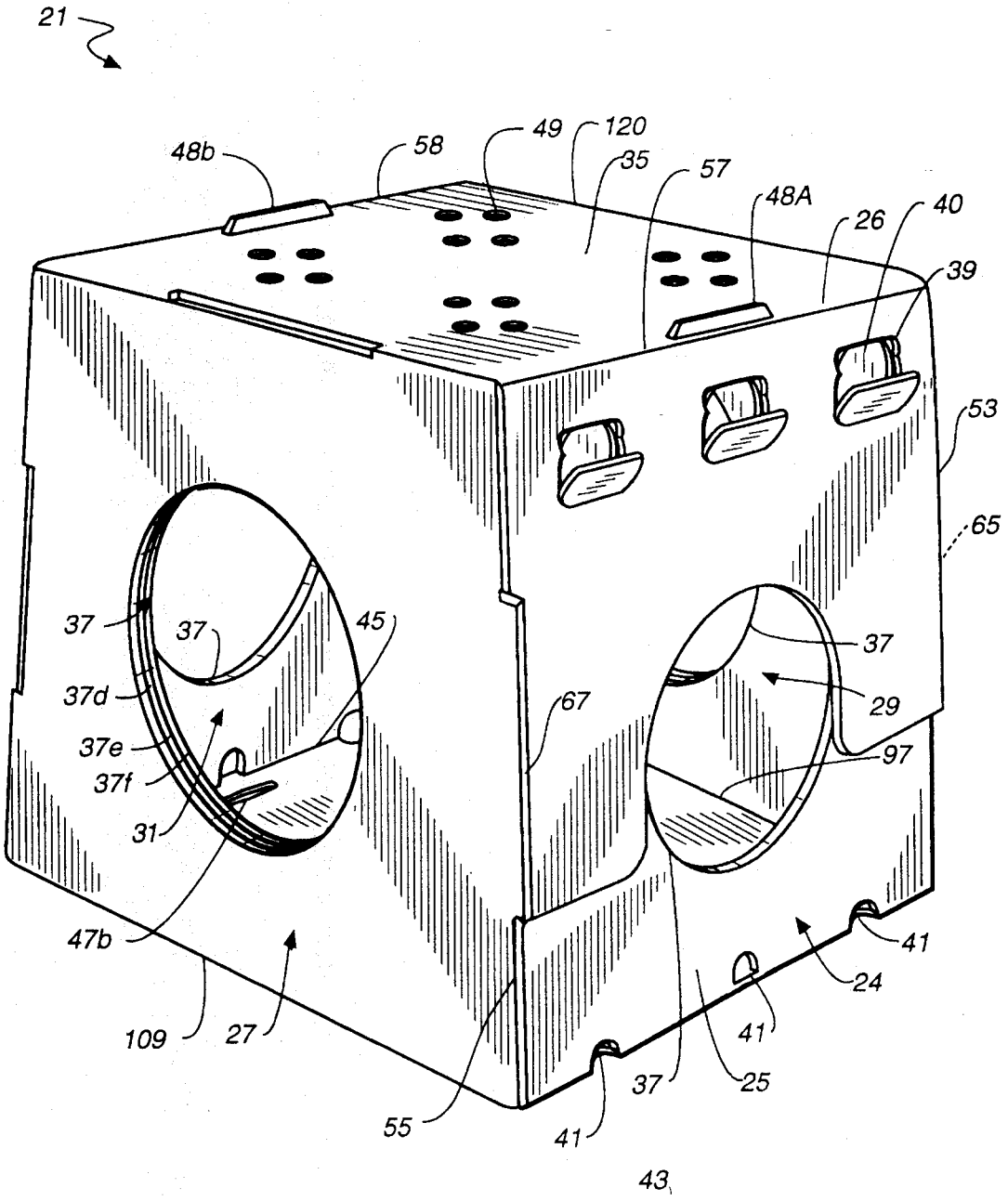
FIG. 1 is a perspective view of a shipping and display box according to an embodiment of the present invention.

A shipping and display box 21 according to an embodiment of the present invention is shown in perspective in FIG. 1. The shipping and display box 21 is preferably formed from a blank 23 such as that shown in FIG. 2 and described further below. The blank 23 is preferably folded, as seen in FIG. 3, so that multi-layer walls are formed, as seen in cross-section in FIG. 4, the walls being characterized by great compressive strength (up to approximately 900 lbs) to facilitate stacking of shipping and display boxes.

Figure 5:
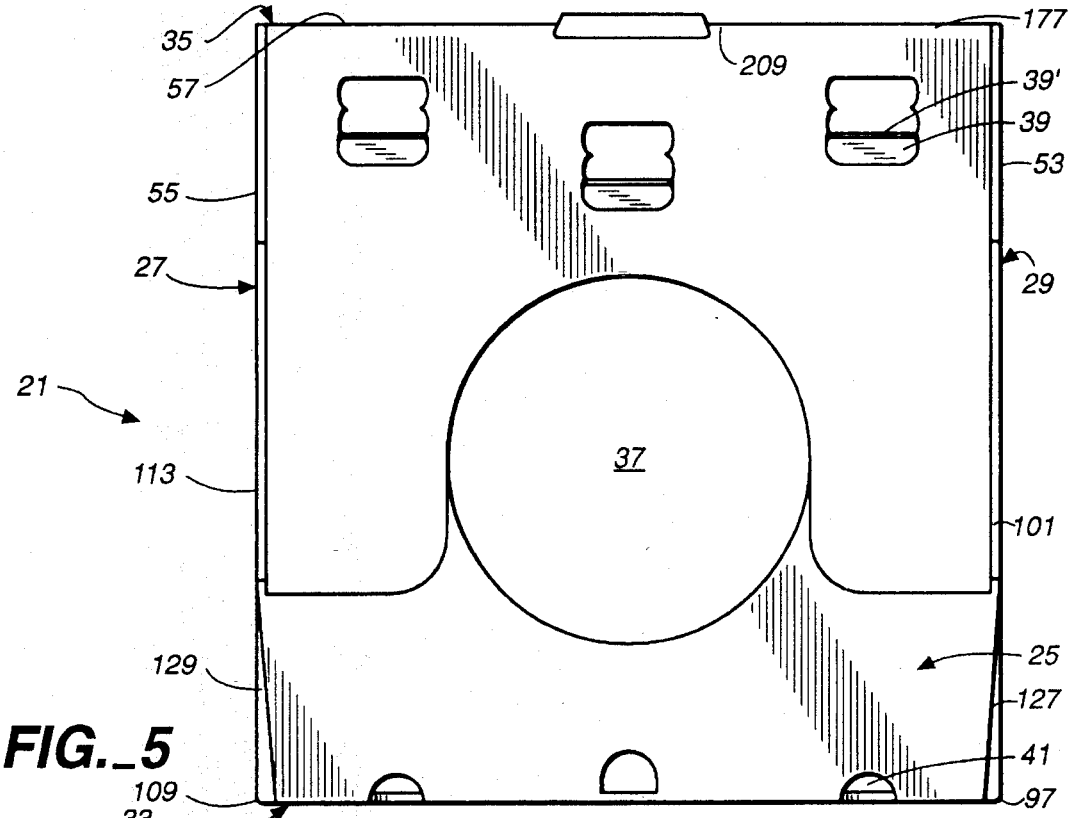
FIG. 5 is a view of a front wall of a shipping and display box according to an embodiment of the present invention.
Figure 9:
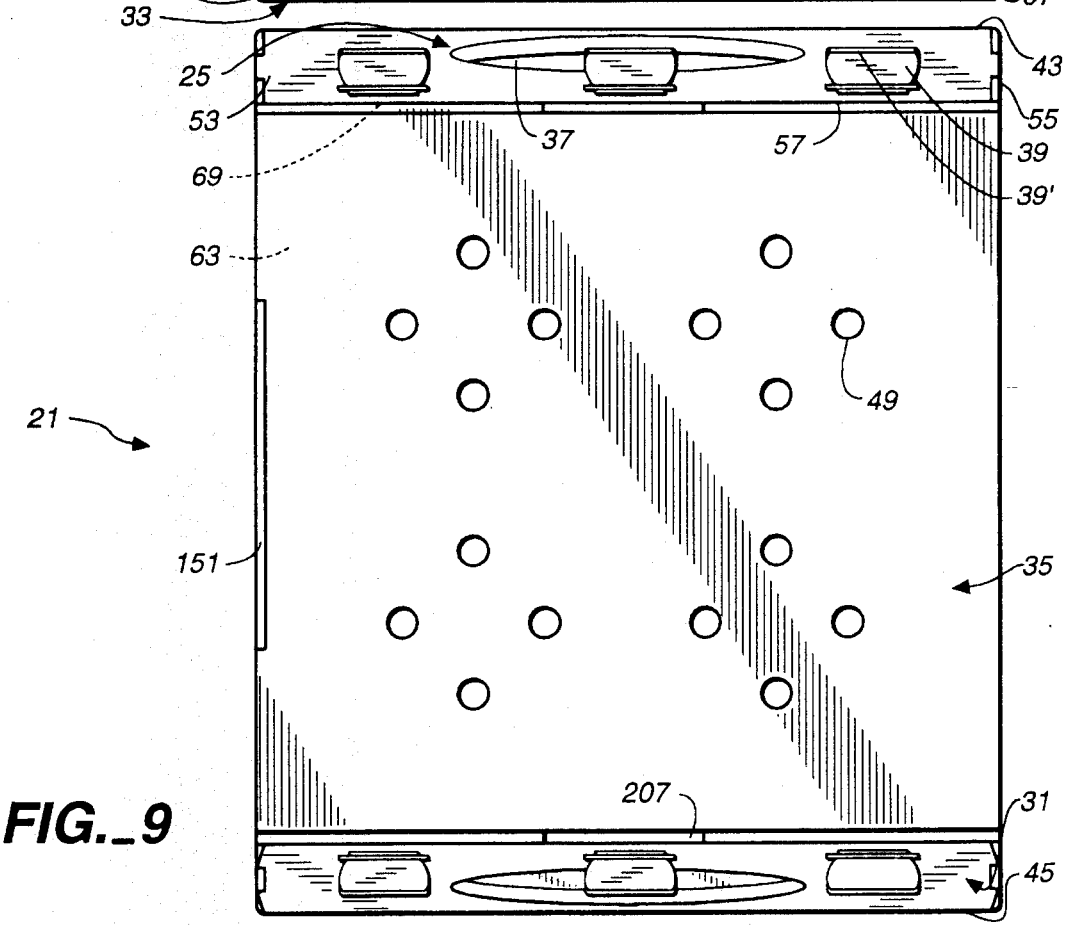
FIG. 9 is a view of a top wall of a shipping and display box according to an embodiment of the present invention.
Figure 6:
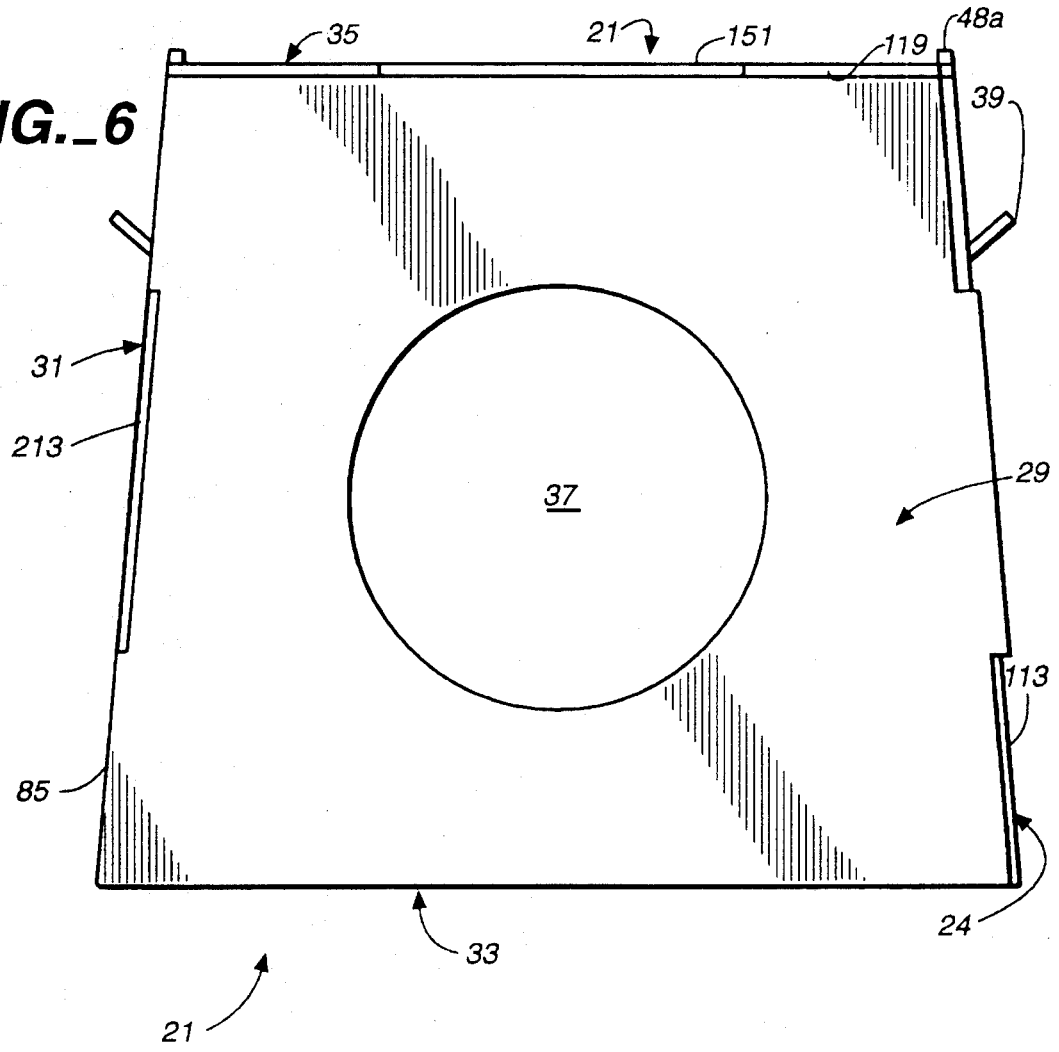
FIG. 6 is a view of a right side wall of a shipping and display box according to an embodiment of the present invention.
Figure 7:
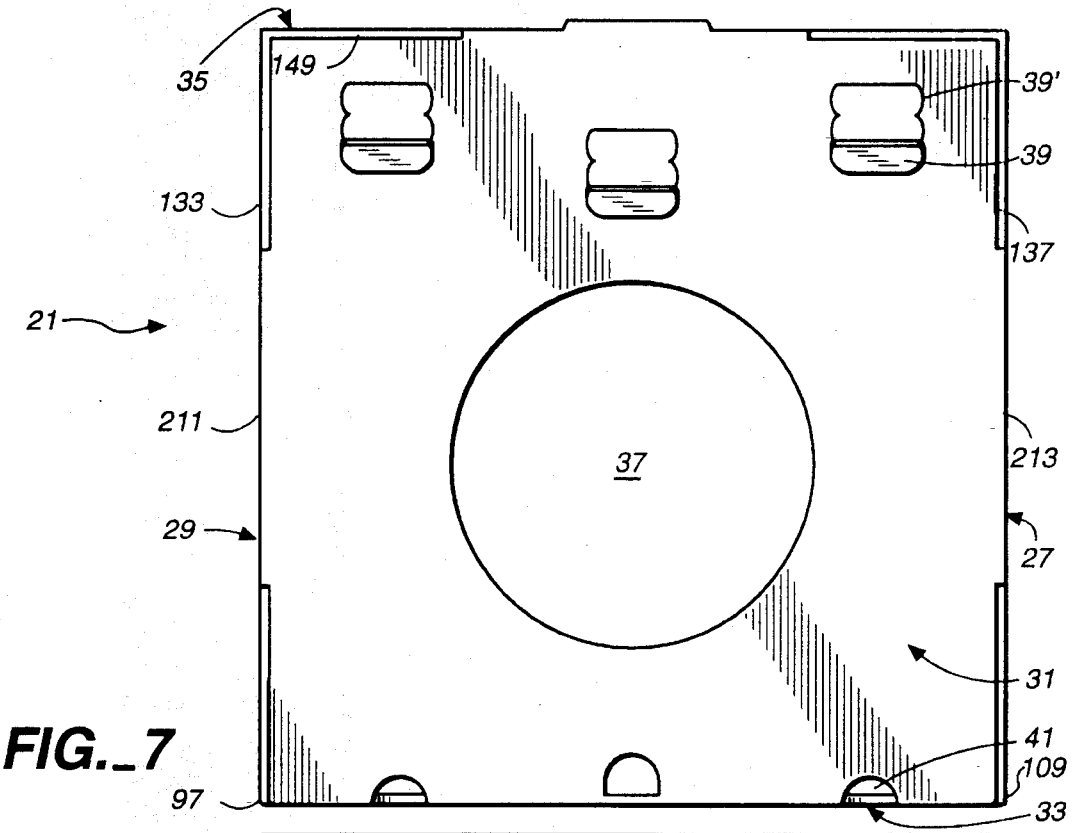
FIG. 7 is a view of a rear wall of a shipping and display box according to an embodiment of the present invention.
Figure 8:
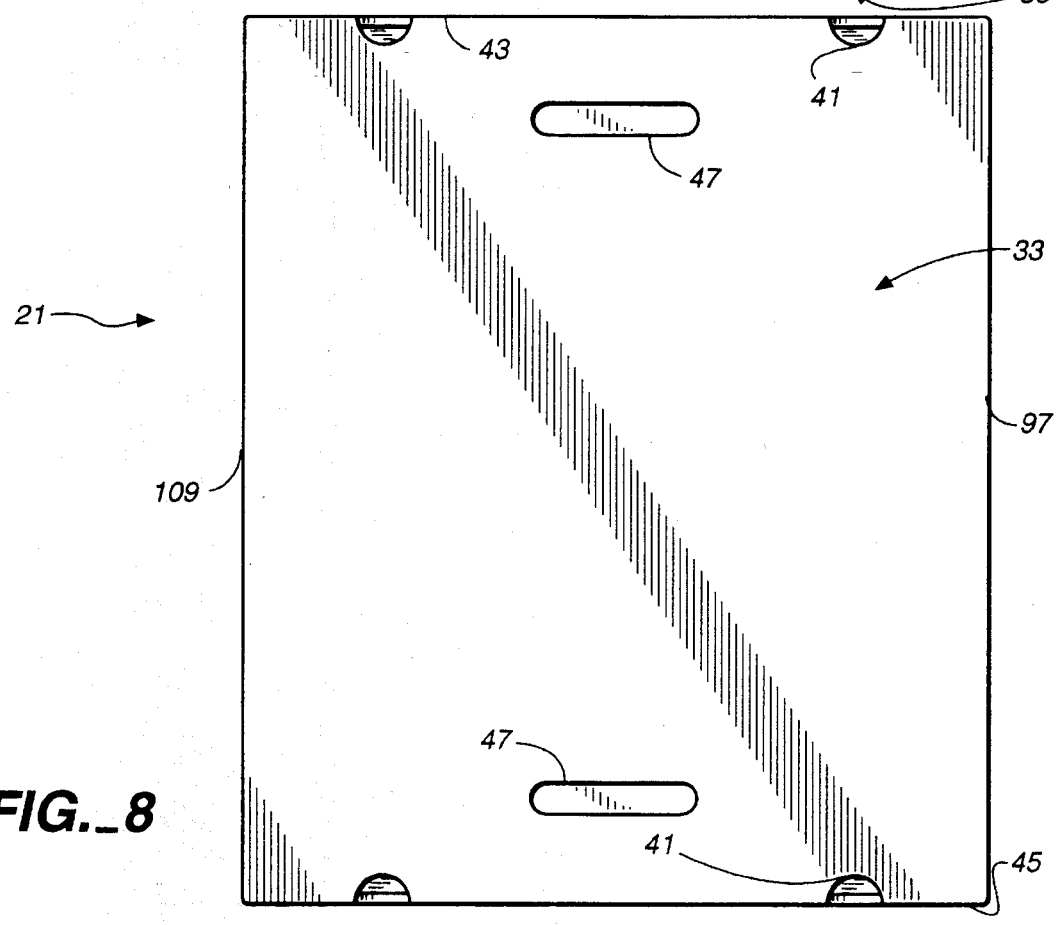
FIG. 8 is a view of a bottom wall of a shipping and display box according to an embodiment of the present invention.

As seen in FIG. 1, the shipping and display box 21 is preferably in the form of a truncated pyramid having an upwardly and inwardly sloping front wall 24 (FIG. 5), the front wall including a primary front wall 25 and a secondary front wall 26, trapezoidal, substantially parallel left and right side walls 27 and 29, respectively (the left side wall shown in FIG. 6 is substantially a mirror image of the right side wall), and an upwardly and inwardly sloping rear wall 31 (FIG. 7). A bottom wall 33 (FIG. 8) and a top wall 35 (FIG. 9) are both preferably substantially square or rectangular. The bottom wall 33 and the top wall 35 are preferably parallel to one another.

The shipping and display box 21 is preferably provided with large holes 37 in each of the front wall 24, the left and right side walls 27 and 29, respectively, and the rear wall 31 to facilitate ventilation and watering of the product (not shown), usually fresh asparagus. The shipping and display box 21 is preferably also provided with perforations for forming diverter tabs 39 on each of the secondary front wall 26 and the rear wall 31. The primary front wall 25, an upper portion of which is covered by the secondary front wall 26, is provided with holes 40 which, in the finished shipping and display box 21, are disposed adjacent to an interior surface of the secondary front wall 26, adjacent to the diverter tabs 39.

The holes 40 are preferably larger than the diverter robs 39 to facilitate the flow of water into the shipping and display box 21 through the diverter tabs and the holes 40. The holes 40, like the holes 37, are preferably round to distribute stresses in the shipping and display box 21 when it is compressed.

The diverter tabs 39 are preferably formed by perforating inverted "U" shapes in the secondary front wall 26 and the rear wall 31 and pushing or pulling the thus-formed substantially half-circle areas away from the walls so that the half-circle areas project away from the walls at an angle. Upper, U-shaped portions 39' of the diverter tabs 39 are preferably removed to facilitate gripping of the diverter tabs and pulling them away from the secondary front wall 26 and the rear wall 31. Removal of these upper portions 39' of the diverter tabs 39 also facilitates ventilation of the finished shipping and display box 21. Corner drain holes 41 and 41' are provided in the region of the bottom front and bottom rear corners 43, 45 of the shipping and display box 21, directly vertically below each of the diverter tabs 39.

Figure 10:
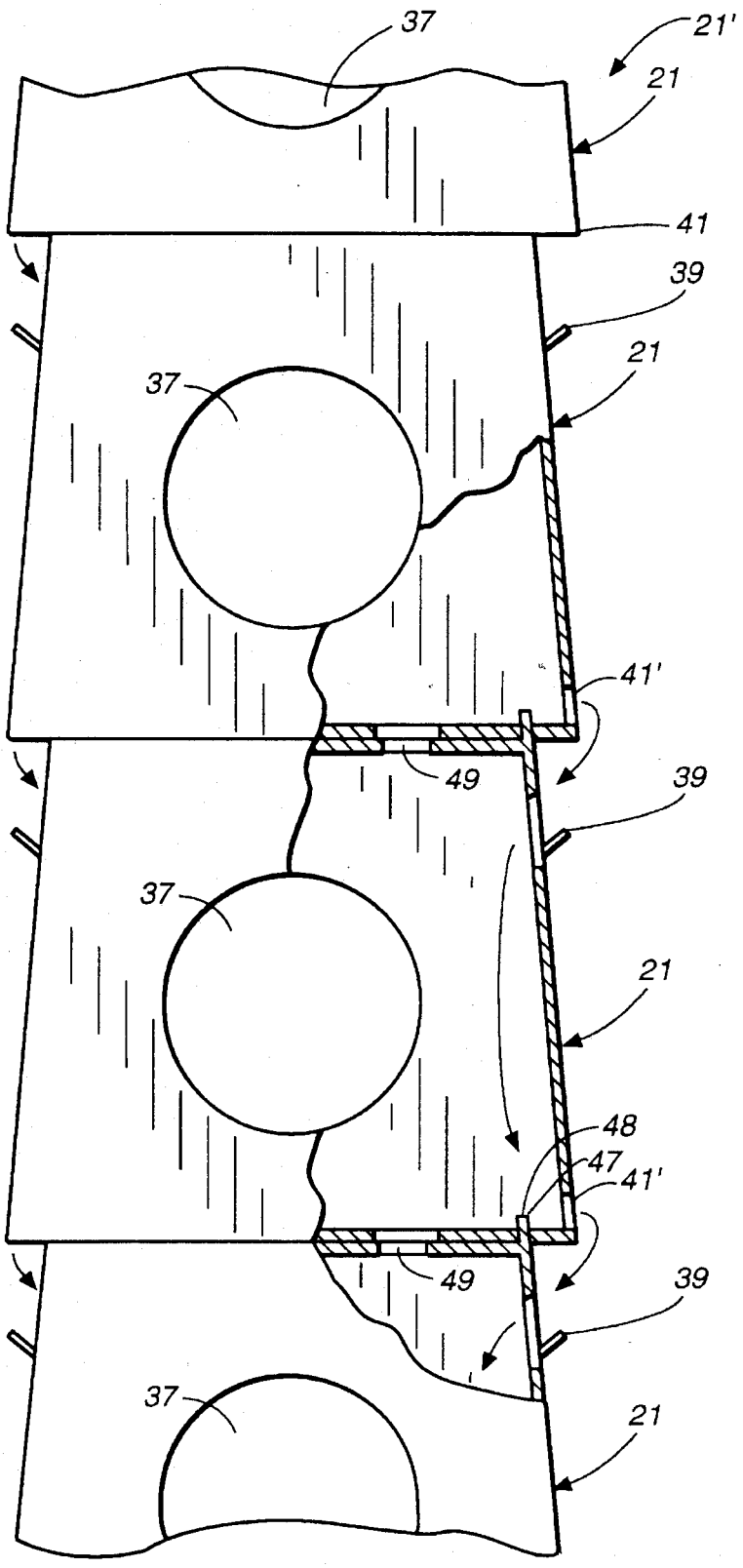
FIG. 10 is a view of a wall of a stack of shipping and display boxes according to an embodiment of the present invention.

As seen in FIG. 10, when shipping and display boxes 21 are arranged in a stack 21' and an upper one of the shipping and display boxes is watered, water flows through the upper one of the boxes, through the corner drain holes 41 and 41' by the bottom wall 33 onto the secondary front wall 26 and the rear wall 31 at points near the top wall 35 (which is narrower than the bottom wall 33). The water then flows into the interior of a lower one of the shipping and display boxes through the holes formed by the diverter tabs 39 on the rear wall 31 and through the holes formed by the diverter tabs on the secondary front wall 26 and the holes 40 on the primary front wall 25.

Figure 11:
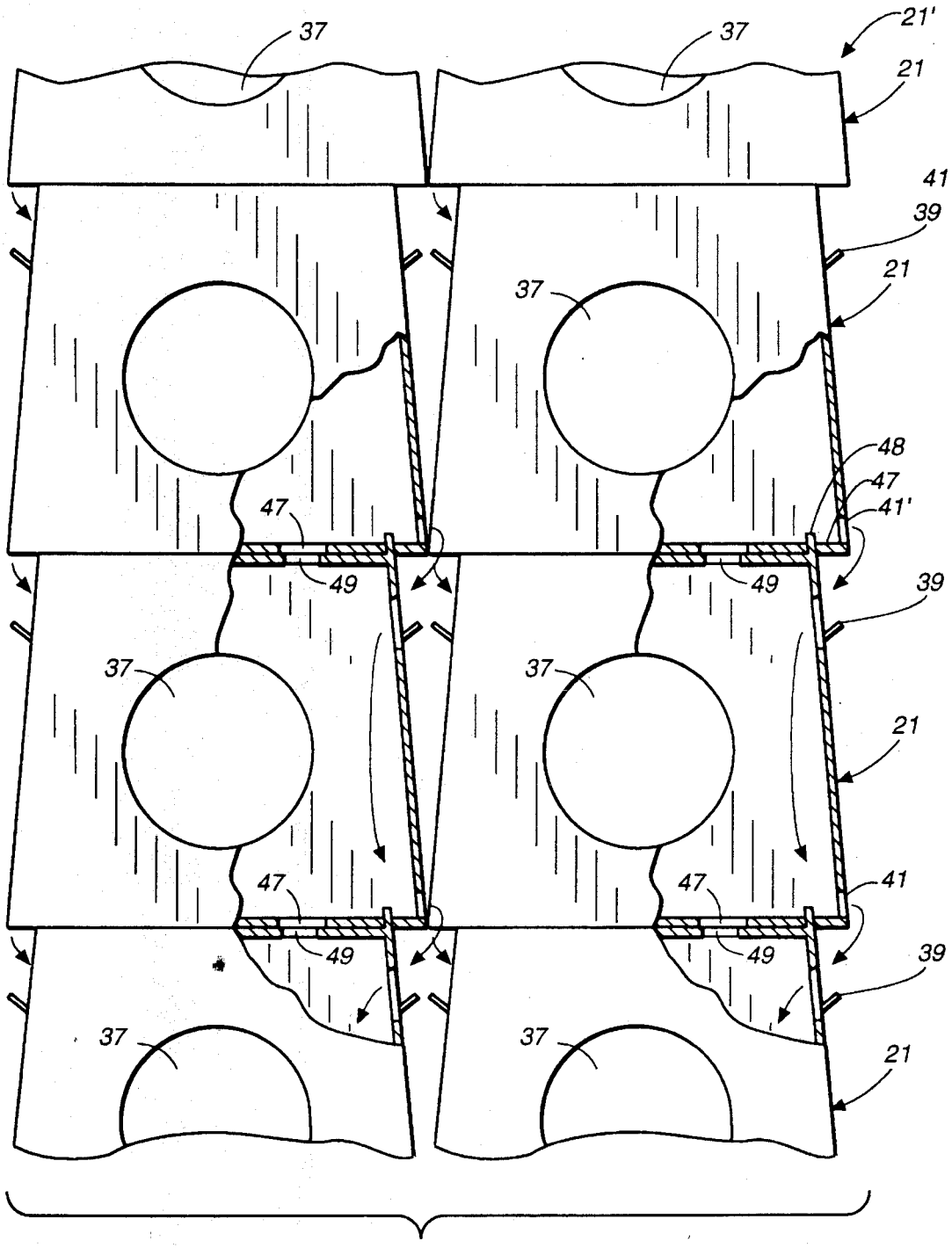
FIG. 11 is a view of a wall of two stacks of shipping and display boxes according to an embodiment of the present invention.

As noted above, each shipping and display box 21 is preferably in the form of a truncated pyramid in which the front and rear walls 24 and 31 slope inwardly and upwardly. As seen in FIG. 11, when stacks of boxes 21 are positioned relative to one another so that the front or rear walls 24 or 31 of the shipping and display boxes of one stack are adjacent the front or rear walls of the shipping and display boxes of another stack, a substantially triangular or wedge-shaped space is formed between the shipping and display boxes of the two stacks.

The wedge-shaped space permits the diverter tabs 39 to extend outwardly from the front and rear walls 24 and 31 without interference from other surfaces, such as diverter tabs on other boxes. Further, the space formed between adjacent stacks 21' of shipping and display boxes facilitates air flow through and around the boxes to keep the produce packed in the boxes fresh. Features such as the diverter tabs 39, the corner drain holes 41, and the inwardly and upwardly sloping front and rear walls 24 and 31 of the shipping and display box 21 facilitate the watering of multiple stacks of boxes by simply watering an uppermost level of the stacks of boxes and allowing the water to flow down through to lowermost ones of the boxes. It is preferred to form stacks 21' of shipping and display boxes 21 having five shipping and display boxes forming the stack, although stacks of other desired numbers of shipping and display boxes can be formed.

Front and rear bottom stacking holes **47*a* and 47*b* are provided in the bottom wall 33 of the shipping and display box 21. Front and rear stacking tabs 48*a* and 48*b* protrude upwardly from a top front corner 57 and a top rear corner 58, respectively, of the shipping and display box 21. As seen in FIG. 10, the front and rear stacking holes 47*a* and 47*b* are displaced in from the bottom front corner 43 and the bottom rear corner 45, respectively, a sufficient distance such that, when one shipping and display box is 21 is stacked on top of another, the front and rear stacking tabs 48*a* and 48*b* are received in the front and rear stacking holes, respectively. Thus, the truncated pyramid shape of the shipping and display box 21 also facilitates accurate, aligned stacking of boxes in that sturdy stacking tabs 48*a* and 48*b* at the top front and top rear corners 57 and 58, respectively, are received in stacking holes 47*a* and 47*b* that are able to be provided in unobstructed portions of the bottom wall 33, at points removed from the bottom front corner 43 and the bottom rear corner 45**, respectively.

The front and rear bottom stacking holes **47*a* and 47*b* and the front and rear top stacking tabs 48*a* and 48*b* provide stability to stacks 21' of shipping and display boxes 21. When the stacking tabs 48*a* and 48*b* are received in the stacking holes 47*a* and 47*b***, the stacked boxes are substantially prevented from sliding relative to one another, i.e., during transport, thereby avoiding damage to products in the boxes.

Further, the stacking holes **47*a* and 47*b* and the stacking tabs 48*a* and 48*b* ensure proper alignment of stacked boxes 21. The stacking holes 47*a* and 47*b* and stacking tabs 48*a* and 48*b* ensure that the corner drain holes 41 and 41' of upper boxes 21 are aligned vertically above the diverter tabs 39 of lower boxes so that water cascading out of the corner drain holes in the upper boxes flows into the diverter tabs of the lower boxes to facilitate hydro-cooling of stacks 21'** of boxes.

Preferably, the front and rear walls 24 and 31 are each provided with three corner drain holes 41 and 41' and with three aligned diverter tabs 39. As seen for example, in FIG. 1, two outer ones of the corner drain holes 41 are provided substantially over the bottom front corner 43. In similar fashion, two outer ones of the corner drain holes 41 are provided substantially over the bottom rear corner 45. Central ones of the corner drain holes 41' are preferably formed in only the primary front wall 25 and in the rear wall 31 and do not extend around the bottom front corner 43 or the bottom rear corner 45. In this manner, additional material is provided between the central corner drain holes 41' and the front and rear stacking holes **47*a* and 47*b*. The additional material provides greater strength to the portions of the bottom wall 33 surrounding the stacking holes 47*a* and 47*b*** and reduces the possibility of relative movement of stacked boxes.

Top ventilation holes 49 are preferably formed in the top wall 35. The top ventilation holes 49 facilitate watering a top one of the shipping and display boxes 21 in a stack 21', as seen in FIG. 10. The large holes 37 provide ventilation of the shipping and display box 21 and are located near the center of each of the front wall 24, the right side wall 27, the left side wall 29, and the rear wall 31.

The holes provided by the diverter tabs 39 and the ventilation holes 49 are all smaller in diameter than the large holes 37. By providing the smaller holes 39 and 49 in a top portion of the shipping and display box 21, a venturi effect is created when the refrigerated, cooler air in the box absorbs heat from the product inside the box, rises to the top of the box, and then passes out of the smaller holes at the upper part of the box. When this warmer air moves out through these smaller holes, the air increases in velocity. This is shown by the mass flow rate equation:

$$Q=pVA$$

where Q is the mass flow rate, p is the mass density, V is the velocity, and A is the cross-sectional area of the orifice.

As the area of an orifice through which a particular volume of air passes in a given time decreases, the velocity of the air increases. Accordingly, as the velocity of the air flow increases through the smaller cross-sectional holes 39 and 49, the venturi effect is understood to result in more air being pulled into the box through the larger, less restricted, ventilation holes 37. This can be represented by the continuity equation:

$$Q=(VA)1=(VA)2$$

where (VA)1 is the velocity of air flow multiplied by the area of the larger hole, and (VA)2 is the velocity of air flow multiplied by the area of the smaller hole. The foregoing assumes that mass density of air is substantially constant, which is a reasonable assumption as velocity and pressure changes of air during normal use hydro-cooling of the contents of the shipping and display box are understood to be minimal.

As seen in FIGS. 1 and 5, the front wall 24 is defined by corners of the shipping and display box 21 including the bottom front corner 43, a right front corner 53, a left front corner 55, and the top front corner 57. The primary front wall 25 is preferably held in a closed position by means including a primary right front wall flap 59 and a primary left front wall flap 61, seen in FIGS. 2 and 3, that are received, respectively, in a right front corner slot 65 in the right front corner 53 and in a left front corner slot 67 in the left front corner 55. The secondary front wall 26 is preferably held in a closed position by means including a secondary right front wall flap 1006 and a secondary left front wall flap 1007, seen in FIGS. 2 and 3, that are also received, respectively, in the right front corner slot 65 and the left front corner slot 67.

The secondary right front wall flap 1006 and the secondary left front wall flap 1007 are provided with locking portions 1006*a* and 1007*a*, respectively, that lock the secondary right and left front wall flaps in the right front corner slot 65 and the left front corner slot 67, respectively. The locking portions 1006*a* and 1007*a* prevent unintended opening of the secondary front wall 26 by extending below lower edges of the right front wall slot 65 and the left front wall slot 67, respectively, and, upon applying pressure to the top wall 35 of the box 21, extend further into the slots to provide even greater locking action.

The top front corner 57 and the bottom front corner 43 preferably form hinges facilitating opening of the shipping and display box 21 upon removing the flaps 1006 and 1007 and the flaps 59 and 61 from the slots 65 and 67 and folding the secondary front wall 26 up at the top front corner and folding the primary front wall 25 down at the bottom front corner. Ordinarily, the secondary front wall 26 is cut or torn off at the top front corner 57 and removed, and the primary front wall 25 is cut or torn off and removed at the bottom front corner 43, and purchasers simply reach into the shipping and display box 21 to remove the products within the box without the need for the merchant to remove the products and place them in a separate display.

Figure 2:
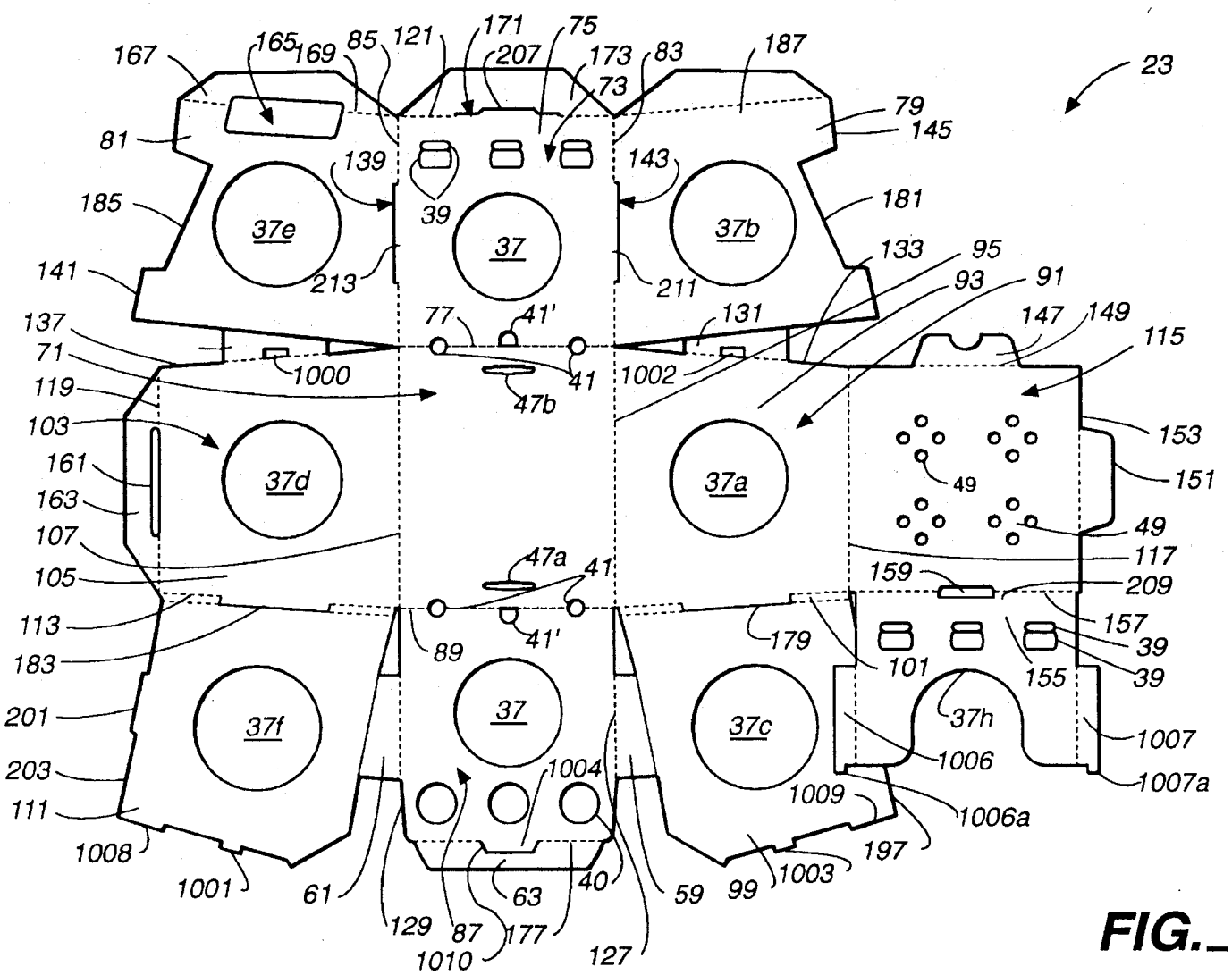
FIG. 2 is a top plan view of a blank for forming a shipping and display box according to an embodiment of the present invention.
Figure 3:
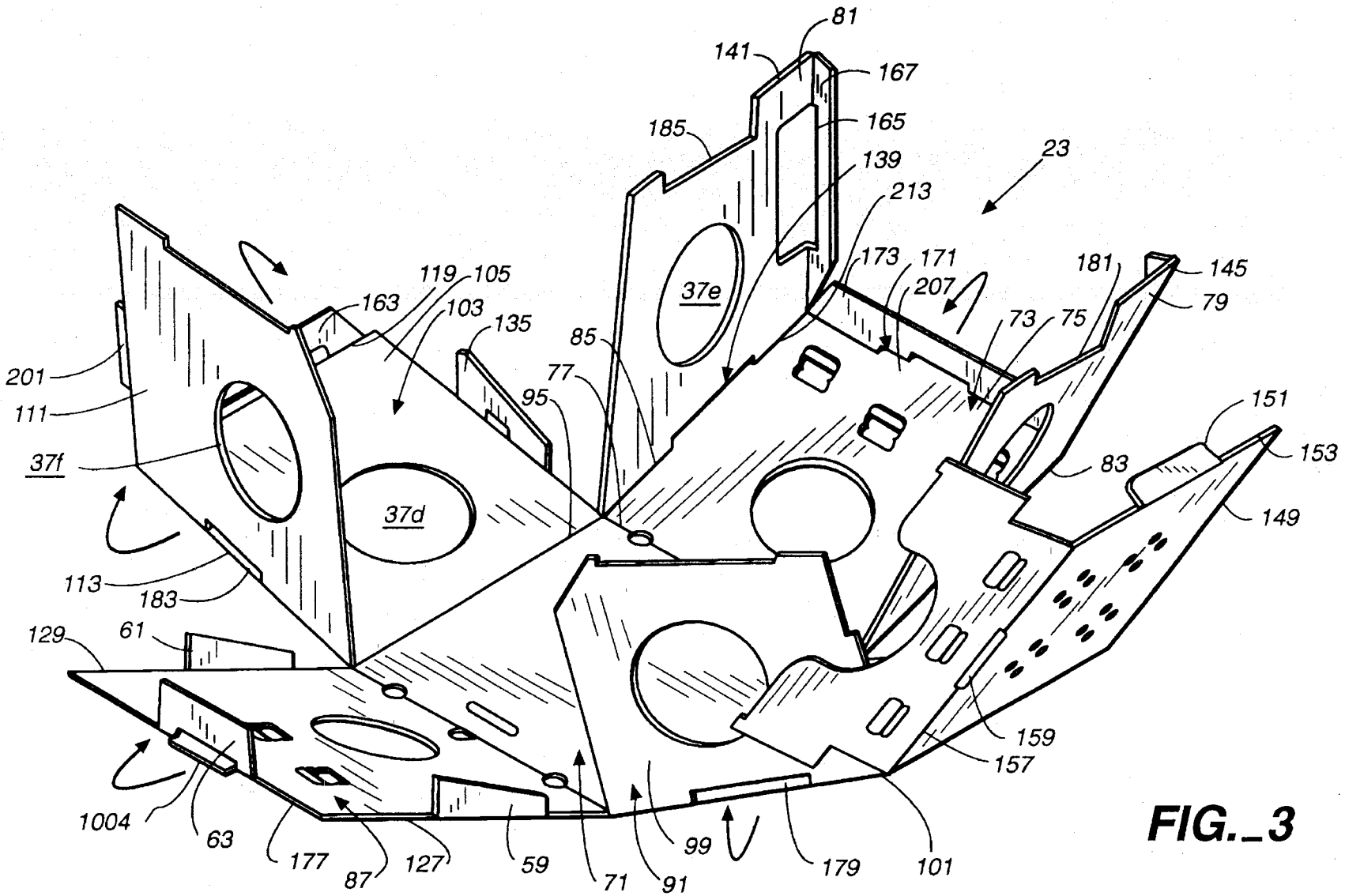
FIG. 3 is a perspective view showing a portion of the assembly of the blank of FIG. 2 into a shipping and display box.

As seen in FIGS. 2 and 3, the blank 23 for forming the shipping and display box 21 includes a bottom wall portion 71 for forming the bottom wall 33. A first portion 73 of the blank 23 includes a central portion 75 hingedly attached to a rear edge 77 of the bottom wall portion 71. In the shipping and display box 21, the central portion 75 forms the rear wall 31 and the rear edge 77 forms the bottom rear corner 45. Trapezoidal right and left portions 79 and 81 are hingedly attached to the central portion 75 of the first portion 73 at right and left edges 83 and 85 of the central portion and, as described below, form part of the right side and left side walls 29 and 27, respectively.

A second portion 87 is hingedly attached to a front edge 89 of the bottom wall portion 71. The second portion 87 forms the primary front wall 25 and the front edge 89 forms the bottom front corner 43 in the finished shipping and display box 21.

A third portion 91 includes a trapezoidal primary portion 93 hingedly attached to a right edge 95 of the bottom wall portion 71. The primary portion 93 forms a portion of the right side wall 29 and the right edge 95 defines a bottom right corner 97 of the finished shipping and display box 21. A trapezoidal secondary portion 99 is hingedly attached to a front edge 101 of the primary portion 93 of the third portion 91 and, as described further below, also forms a portion of the right side wall 29.

A fourth portion 103 includes a trapezoidal primary portion 105 hingedly attached to a left edge 107 of the bottom wall portion 71. The primary portion 105 forms a portion of the left side wall 27 and the left edge 107 defines a bottom left corner 109 of the finished shipping and display box 21. A trapezoidal secondary portion 111 is hingedly attached to a front edge 113 of the primary portion of the fourth portion 103 and, as described further below, also forms a portion of the left side wall 27. The fourth portion 103 is substantially a mirror image of the third portion 91, except as otherwise noted.

A top wall portion 115 is hingedly attached to one of a right edge 117 of the primary portion 93 of the third portion 91, a left edge 119 of the primary portion 105 of the fourth portion 103, and a rear edge 121 of the central portion 75 of the first portion 73. As seen in the blank 23 illustrated in FIGS. 2 and 3, the top wall portion 115 is hingedly attached to the right edge 117 of the primary portion 93 of the third portion 91 so that, in the finished snipping and display box 21, the right edge of the primary portion of the third portion forms a top right corner 120. A secondary front wall flap 155 is hingedly attached to the top wall portion 115 at one of a forward edge of the top wall portion, a forward edge of the top wall portion, and a rear edge of the top wall portion when the top wall portion is hingedly attached to one of the right edge 117 of the primary portion 93 of the third portion 91, the left edge 119 of the primary portion 105 of the fourth portion 103, and the rear edge 121 of the central portion 75 of the first portion 73, respectively. In the finished shipping and display box 21, the secondary front wall flap 155 forms the secondary front wall 26.

In the embodiment of the blank 23 shown in FIGS. 2 and 3, a secondary front wall flap 155 is hingedly attached at the front edge 157 of the top wall portion 115. The front edge 157 defines the top front edge 57 of the finished shipping and display box 21. Assembly of the blank 23 shown in FIGS. 2 and 3 into the shipping and display box 21 is described below for purposes of illustration, however, it is understood that other arrangements of portions will accomplish the objects of the present invention.

A plurality of cuts or perforations, slots, and flaps are preferably provided to facilitate assembly of the shipping and display box 21 without the need for staples, straps, or other mechanical fasteners. The trapezoidal shapes of the right and left portions 79 and 81 of the first portion 73, the primary and secondary portions 93 and 99 of the third portion 91, and the primary and secondary portions 105 and 111 of the fourth portion 103 facilitate provision of certain of the above-mentioned flaps for holding together vertical corners of the shipping and display box 21. Such flaps include the primary right and left front wall flaps 59 and 61 provided at right and left edges 127 and 129, respectively, of the second portion 87, a rear flap 131 at the rear edge 133 of the primary portion 93 of the third portion, and a rear flap 135 at the rear edge 137 of the primary portion 105 of the fourth portion 103. As seen in FIG. 2, formation of portions of the secondary front wall flap 155 and the secondary right front wall flap 1006 results in a left edge 197 of the third portion 91 being irregularly shaped.

The blank 23 shown in FIG. 2 is folded, as shown in FIG. 3, to form the shipping and display box 21 substantially as follows. The first portion 73 is folded, at the rear edge 77 of the bottom portion 71, relative to the bottom portion to form the bottom rear edge 45. The right and left portions 79 and 81 of the first portion are folded, at the right and left edges 83 and 85 of the central portion 75, relative to the central portion so that they are substantially aligned with the right and left edges 95 and 107 of the bottom portion 71.

The fourth portion 103 is folded, at the left edge 107 of the bottom portion 71, relative to the bottom portion so that the primary portion 105 of the fourth portion is adjacent an outer side of the left portion 81 of the first portion 73. The rear flap 135 on the rear edge 137 of the primary portion 105 of the fourth portion 103 is folded relative to the primary portion of the fourth portion and is inserted into a left edge slot 139 on the left edge 85 of the central portion 75 of the first portion 73. The secondary portion 111 of the fourth portion 103 is folded around a left edge 141 of the left portion 81 of the first portion 73 so that the secondary portion is adjacent an inner side of the right portion, and a tab 1001 at a notched front edge 1008 of the secondary portion is inserted into a slot 1000 provided in the rear flap 135 to lock the secondary portion in position and thereby facilitate providing a maximum internal dimension of the shipping and display box 21.

A notched portion of the front edge 1008 facilitates placing the front edge of the secondary portion 111 over the rear flap 135 such that the rear flap is disposed between the notch in the front edge of the secondary portion and the central portion 75. The primary and secondary portions 105 and 111 of the fourth portion 103 and the left portion 81 of the first portion 73 thereby form the triple-thickness left side wall 27 of the shipping and display box 21, seen, for example, in FIG. 4.

The third portion 91 is folded, at the right edge 95 of the bottom portion 71, relative to the bottom portion so that the primary portion 93 of the third portion is adjacent an outer side of the right portion 79 of the first portion 73. The rear flap 131 on the rear edge 133 of the primary portion 93 of the third portion 91 is folded relative to the primary portion of the third portion and is inserted into a right edge slot 143 on the right edge 83 of the central portion 75 of the first portion 73. The secondary portion 99 of the third portion 91 is folded around a right edge 145 of the right portion 79 of the first portion 73 so that the secondary portion is adjacent an inner side of the left portion, and a tab 1003 at a notched front edge 1009 of the secondary portion 99 is inserted into a slot 1002 provided in the rear flap 131 to lock the secondary portion in position and thereby facilitate providing a maximum internal dimension of the shipping and display box 21.

A notched portion of the front edge 1009 facilitates placing the front edge of the secondary portion 99 over the rear flap 131 such that the rear flap is disposed between the notch in the front edge of the secondary portion and the central portion 75. The primary and secondary portions 93 and 99 of the third portion 91 and the right portion 79 of the first portion thereby form the triple-thickness right side wall 29 of the shipping and display box 21, seen, for example in FIG. 4.

A top rear flap 147 is provided at a rear edge 149, a top right flap 151 is provided at a right edge 153, and the secondary front wall flap 155 is provided at a front edge 157 of the top wall portion 115. A slot 159 is provided in the at the front edge 157 of the top wall portion. The top wall portion 115 is folded, at the right edge 117 of the primary portion 93 of the third portion 91, relative to the primary portion of the third portion so that it forms the top wall 35 of the shipping and display box 21.

The top right flap 151 is received through a slot 161 provided in a left flap 163 at the left edge 119 of the primary portion 105 of the fourth portion 103 and in a slot 165 provided in a flap 167 at a rear edge 169 of the left portion 81 of the first portion 73. The top right flap 151 is thereby securely fitted, in line with the left portion 81 of the first portion 73, between an inner side of the primary portion 105 and an outer side of the secondary portion 111 of the fourth portion 103. The shape of a portion of the slot 165 extending into the left portion 81 from the rear edge 169 corresponds to the shape of a leading portion of the top right flap 151 such that the leading portion of the top right flap is substantially wholly received in the portion of the slot. At substantially the same time, the top rear flap 147 is fitted into a slot 171 in a flap 173 at the rear edge 121 of the central portion 75 of the first portion 73. In this manner, the top wall 35 is secured to the rear wall 31 and the left side wall 27 of the shipping and display box 21.

The second portion 87 is provided with a top front wall flap 63 at a front edge 177 of the second portion. The top front wall flap 63 is provided with a slot 1010 which is formed such that, when the flap 63 is folded relative to the front edge 177 of the second portion 87, a protruding portion 1004 of the slot extends upwardly from the front edge to form the top front stacking tab **48*a***.

To secure the primary front wall 25 in a closed position relative to the rest of the shipping and display box 21, the second portion 87 is folded, relative to the bottom wall portion 71, at the front edge 89 of the bottom wall portion. The primary right and left front wall flaps 59 and 61 and the top front wall flap 63 are folded relative to the second portion 87. The top front stacking tab **48*a* formed by the protruding portion 1004 extends through the slot 159 at the front edge 157 of the top portion 115 and facilitates locking the primary front wall 25 relative to the top wall 35, as well as facilitating stacking and alignment of shipping and display boxes 21**, as discussed above.

The primary right front wall flap 59 is received through a slot 179 at the front edge 101 of the primary portion 93 of the third portion 91 and in a recess 181 in the right edge 145 of the right portion 79 of the first portion 73, the slot 179 and the recess 181 forming the right front corner slot 65 in the finished shipping and display box 21. The primary left front wall flap 61 is received through a slot 183 at the front edge 113 of the primary portion 105 of the fourth portion 103 and in a recess 185 in the left edge 141 of the left portion 81 of the first portion 73, the slot 183 and the recess 185 forming the left front corner slot 67.

The secondary front wall flap 155 is folded downward at the front edge 157 of the top wall portion 115 and the secondary right front wall flap 1006 and the secondary left front wall flap 1007 are folded inward. The secondary right front wall flap 1006 is received through the slot 179 and in the recess 181 forming the right front corner slot 65 and the secondary left front wall flap 1007 is received through the slot 183 and in the recess 185 forming the left front corner slot 67. The secondary right and left front wall flaps 1006 and 1007 are disposed outside of the primary right and left front wall flaps 59 and 61, respectively, in the slots 65 and 67, respectively.

The recesses 181 and 185 are longer than the slots 179 and 183, respectively, so that lower portions of the recesses extend below lower edges of the slots. The locking portions **1006*a* and 1007*a* extend down into the lower portions of the recesses 181 and 185, respectively, behind the bottom edges of the slots 179 and 183, respectively, to lock the secondary front wall 26 in position. Risk of damage to delicate produce such as asparagus in the shipping and display box 21 is minimized, upon closing the primary front wall 25 and the secondary front wall 26, because the primary right front wall flap 59 and the secondary right front wall flap 1006 are each received in the right front wall slot 65 and the primary left front wall flap 61 and the secondary left front wall flap 1007 are each received in the left front wall slot 67, and those flaps do not come into contact with the produce. Thus, in addition to providing a shipping and display box 21 having great compressive strength, the triple thickness construction of the left side and right side walls 27 and 29 facilitates provision of the left front wall slot 67 and the right front wall slot 65 that permit closing of the primary and secondary front walls 25 and 26** with minimal risk of damage to produce in the box.

A protruding member 201 extends from a left edge 203 of the secondary portion 111 of the fourth portion 103. In the assembled shipping and display box 21, the protruding member 201 is received in the slot 165 in the flap 167 at the rear edge 169 of the left portion 81 of the first portion 73 and in the slot 161 in the left flap 163 of the primary portion 105 of the fourth portion 103. The protruding member 201 and the slots 161 and 165 facilitate forming a tight grip on the top right flap 151 on the top portion 115.

The slot 171 provided in the flap 173, the right edge slot 143 on the right edge 83 of the central portion 75 of the first portion 73, and the left edge slot 139 provided on the left edge 85 of the central portion 75 of the first portion 73 are preferably formed such that, when the flap 173, the right portion 79, and the left portion 81 are folded, protruding members 207, 211, and 213, respectively, are formed. The formation of the slot 171 to provide the protruding member 207 facilitates providing a tight grip on the top rear flap 147 on the top portion 115. The protruding member 207 also forms the top rear stacking tab 48*b*, discussed above, in the finished shipping and display box 21. The formation of the slot 143 to provide a protruding member 211 facilitates providing a tight grip on the rear flap 131 on the rear edge 133 of the primary portion 93 of the third portion 91. The formation of the slot 139 to provide a protruding member 213 facilitates providing a tight grip on the rear flap 135 on the rear edge 137 of the primary portion 105 of the fourth portion 103.

The slot 179 at the front edge 101 of the primary portion 93 of the third portion 91 preferably forms a protruding portion when the secondary portion 99 is folded at the front edge, and the slot 183 at the front edge 113 of the primary portion 105 of the fourth portion 103 preferably forms a protruding portion when the secondary portion 111 is folded at the front edge. The protruding portion formed by the slot 179 facilitates providing a tight grip on the right primary and secondary flaps 59 and 1006. The protruding portion formed by the slot 183 facilitates providing a tight grip on the left primary and secondary flaps 61 and 1007.

Figure 4:
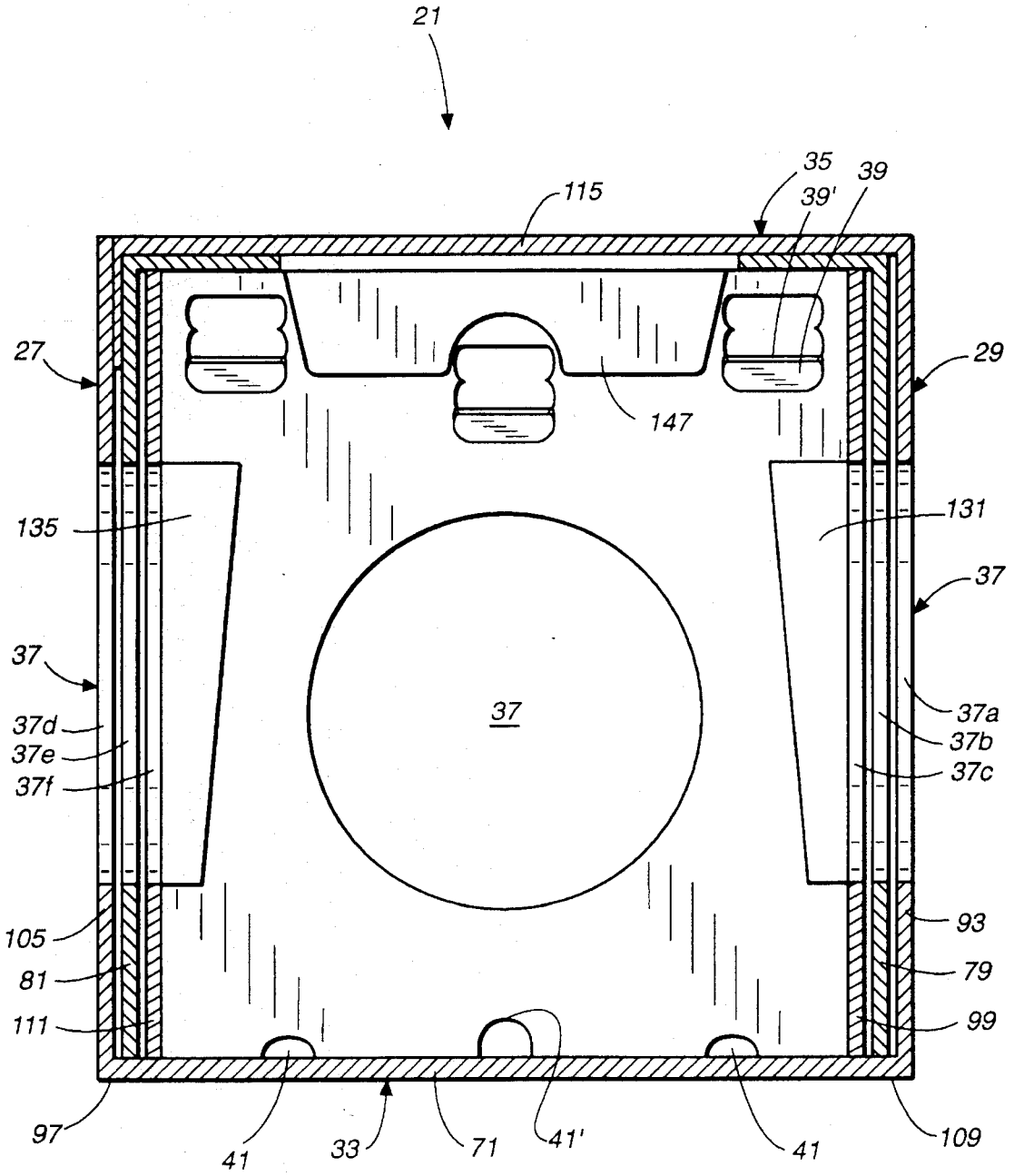
FIG. 4 is a cross-sectional side view of the shipping and display box of FIG. 1, taken at section 4—4 of FIG. 1.

The holes 37 in the front wall 24, the left side wall 27, the right side wall 29, and the rear wall 31, the perforations or cuts for forming the diverter tabs 39, the corner drain holes 41 and 41', the bottom stacking holes 47, and the top ventilation holes 49 are preferably formed when the blank 23 is cut. The hole 37 in the right side wall 29 is formed by holes 37*a*, 37*b*, and 37*c* formed in the primary portion 93 of the third portion 91, the right portion 79 of the first portion 73, and the secondary portion 99 of the third portion, respectively. When the right side wall 29 is formed as described above, the holes 37*a*, 37*b*, and 37*c* form the hole 37 in the right side wall, as seen in FIG. 4.

Similarly, the hole 37 in the left side wall 27 is formed by holes 37*d*, 37*e*, and 37*f* in the primary portion 105 of the fourth portion 103, the left portion 81 of the first portion 73, and the secondary portion 111 of the fourth portion, respectively. When the left side wall 27 is formed as described above, the holes 37*d*, 37*e*, and 37*f* form the hole 37 in the left side wall. The hole 37 in the front wall 24 is formed by a hole 37*g* and a recess 37*h* formed in the second portion 87 and in the secondary front flap 155, respectively. When the front wall 24 is formed, as described above, the recess 37*h* aligns with an upper portion of the hole 37*g*, as seen in FIG. 1.

The shipping and display box 21 is made from any one of the known materials for forming packing containers. Preferred characteristics of materials for forming the shipping and display box 21 include high strength in compression. A preferred material for use in the shipping and display container 21 is waxed corrugated cardboard. Another material suited for use in the shipping and display box 21 is recyclable corrugated plastic.

When the shipping and display box is used to transport fresh products, it is typical to provide an absorbent pad (not shown) inside the bottom of the shipping and display box to hold water so that the fresh product will be in contact with the water in the pad. As noted above, fresh products in multiple stacks of shipping and display boxes 21 may be simultaneously watered or "hydro-cooled" to maintain freshness of the products by watering a top level of the multiple boxes and allowing the water to flow down to lower boxes through the various drain holes, diverter tabs, etc. When asparagus is the fresh product, it is desired to maintain a very low temperature of the asparagus to prevent growth of the asparagus, and to prevent rot and deterioration of the asparagus. Accordingly, materials for forming the shipping and display box will desirably not be adversely affected by low temperature.

The foregoing has described the principles, preferred embodiments and modes of operation of the present invention. However, the invention should not be construed as limited to the particular embodiments discussed. Instead, the above-described embodiments should be regarded as illustrative rather than restrictive, and it should be appreciated that variations may be made in those embodiments by workers skilled in the art without departing from the scope of the present invention as defined by the following claims.

What is claimed is:

1. A stackable box, comprising:

a horizontal bottom wall provided with one or more openings;

a horizontal top wall;

a front wall and a rear wall extending between the top wall and the bottom wall; and upwardly extending stacking tabs, at least one of the stacking tabs being disposed at each of a top front and a top rear corner of the box, wherein the openings provided in the bottom wall correspond in number to the stacking tabs, have internal dimensions corresponding to external dimensions of the stacking tabs, and are provided in the bottom wall vertically below the stacking tabs, and a left and a right edge of the top wall are each smaller than corresponding left and right edges of the bottom wall and a front and a rear edge of the top wall are each substantially the same length as corresponding front and rear edges of the bottom wall.

2. The stackable box as set forth in claim 1, further comprising an angled front wall extending between the front edge of the bottom wall and the front edge of the top wall and an angled rear wall extending between the rear edge of the bottom wall and the rear edge of the top wall.

3. The stackable box as set forth in claim 2, wherein one or more inverted U-shaped perforations for forming tabs are formed in at least one of the front and rear walls, the tabs being adapted to be folded outwardly from the front and rear walls and form upper drain holes, and bottom drain holes are formed proximate at least one of the bottom edge of the front wall and the bottom edge of the rear wall vertically below the upper drain holes.

4. The stackable box as set forth in claim 3, wherein ventilation holes are provided in at least one of the front and rear walls below the inverted U-shaped perforations, the ventilation holes being larger than the upper drain holes.

5. The stackable box as set forth in claim 2, wherein one stacking tab at the top front corner is formed by an edge of the front wall and one stacking tab at the top rear corner is formed by an edge of the rear wall.

6. The stackable box as set forth in claim 2, further comprising a trapezoidal side wall between the front and rear walls.

7. The stackable box as set forth in claim 2, wherein the trapezoidal side wall is formed of more than one layer of the blank material.

8. A stackable box, comprising:

a horizontal bottom wall provided with one or more first holes proximate an edge of the bottom wall;

an upwardly extending wall attached at an edge of the bottom wall so that the upwardly extending wall and the bottom wall form an angle of less than ninety degrees, measured on an inner side of the box; and one or more first holes being provided proximate the edge of the bottom wall and one or more second holes, corresponding in number to the one or more first holes, being provided in the upwardly extending wall, the one or more second holes being provided vertically above the one or more first holes.

9. The box as set forth in claim 8, wherein the one or more second holes are provided by pulling inverted, U-shaped regions defined by perforations, the U-shaped regions being formed in the upwardly extending wall, away from the upwardly extending walls to form outwardly extending tabs, the outwardly extending tabs being adapted to divert water falling onto the tabs through the one or more second holes in the stackable box and into the stackable box.

10. A box, comprising:

a bottom wall;

a rear wall, at least a portion of the rear wall being hingedly attached at a rear edge to the bottom wall;

a left side wall, at least a portion of the left side wall being hingedly attached to a left edge of the bottom wall;

a right side wall, at least a portion of the right side wall being hingedly attached to a right edge of the bottom wall;

a top wall, at least a portion of the top wall being hingedly attached to one of the rear wall, the left side wall, and the right side wall;

a primary front wall, at least a portion of the primary front wall being hingedly attached to a front edge of the bottom wall;

a secondary front wall, at least a portion of the secondary front wall being hingedly attached to a front edge of the top wall; and integral slot and flap means for securing the bottom wall, the rear wall, the left side wall, the right side wall, the top wall, the primary front wall, and the secondary front wall relative to one another, wherein slots are provided on a left front edge and right front edge of the box for receiving flaps on left and right edges of the primary and secondary front walls such that the flaps do not enter an interior of the box.

11. The box as set forth in claim 10, wherein portions of the left and right side walls are formed by left and right portions hingedly attached to the rear wall.

12. The box as set forth in claim 10, wherein the left and right side walls are trapezoidal.

13. The box as set forth in claim 10, wherein the box is in the form of a truncated pyramid.

14. The box as set forth in claim 10, wherein the flaps on the left and right edges of the secondary front wall include locking portions for hindering removal of the flaps on the left and right edges of the secondary front walls from the slots on the left front edge and the right front edge of the box.

15. The box as set forth in claim 10, further comprising one or more top stacking tabs provided at one or more top edges of the box, the bottom wall being formed with openings corresponding in number to the top stacking tabs, having internal dimensions corresponding to external dimensions of the stacking tabs, and being disposed vertically below the top stacking tabs.

16. A blank for forming a box, the blank comprising:

a bottom wall portion for forming a bottom wall;

a first portion including a central portion hingedly attached to a rear edge of the bottom wall portion for forming a rear wall, and left and right portions at left and right edges of the central portion;

a second portion hingedly attached to a front edge of the bottom wall portion for forming a primary front wall, left and right edges of the second portion each having one or more flaps;

a third portion including a primary portion hingedly attached to a left edge of the bottom wall portion and a secondary portion hingedly attached to a front edge of the primary portion, one or more slots being formed on the front edge of the primary portion;

a fourth portion including a primary portion hingedly attached to a right edge of the bottom wall portion and a secondary portion hingedly attached to a front edge of the primary portion, one or more slots being formed on the front edge of the primary portion; and a top wall portion, the top wall portion being hingedly attached to one of a left edge of the primary portion of the third portion, a right edge of the primary portion of the fourth portion, and a rear edge of the first portion, wherein, in the box formed from the blank, a left wall is formed from the primary and secondary portions of the third portion folded around the left portion of the first portion and a right wall is formed from the primary and secondary portions of the fourth portion folded around the right portion of the first portion, and the one or more slots provided on the front edge of the primary portion of the third portion and on the front edge of the primary portion of the fourth portion receive the one or more flaps on the left and the right edges of the primary front wall, respectively, the one or more flaps being received in an area between the primary and secondary portions of the third and fourth portions and do not enter an interior of the box.

17. A blank for forming a box as set forth in claim 16, further comprising a secondary front wall hingedly attached to the top wall portion at one of a forward edge of the top wall portion, a forward edge of the top wall portion, and a rear edge of the top wall portion when the top wall portion is hingedly attached to one of the left edge of the primary portion of the third portion, the right edge of the primary portion of the fourth portion, and the rear edge of the first portion, respectively.

* * * * *